United States Patent [19]

Lo

[11] Patent Number: 5,029,723

[45] Date of Patent: Jul. 9, 1991

[54] STORAGE CONTAINER WITH PIVOTABLE COVER

[76] Inventor: Mei Y. Lo, No. 343, Huan Nan Rd., Chung Li, Taiwan, R.O.C.

[21] Appl. No.: 584,057

[22] Filed: Sep. 18, 1990

Related U.S. Application Data

[63] Continuation-in-part of Ser. No. 448,253, Dec. 11, 1989, abandoned.

[51] Int. Cl.[5] ..... B65D 43/04

[52] U.S. Cl. ..... 220/282; 220/231

[58] Field of Search ..... 220/282, 231, 356, 366

[56] References Cited

U.S. PATENT DOCUMENTS

| | | | |
|---|---|---|---|
| 1,115,081 | 10/1914 | Metzger | 220/282 |
| 1,335,787 | 4/1920 | Krause | 220/282 |
| 1,369,819 | 3/1921 | Krause | 220/282 |
| 2,026,463 | 12/1935 | Driess | 220/282 |
| 2,138,061 | 11/1938 | Friedinger | 220/282 |
| 2,333,117 | 11/1943 | Nyden | 220/282 |
| 2,379,679 | 7/1945 | Burdick | 220/282 |
| 3,327,890 | 6/1967 | Burdick, Jr. | 220/282 |
| 3,741,431 | 6/1973 | Burdick | 220/282 |
| 3,995,766 | 12/1976 | Fralick | 220/282 |
| 4,807,778 | 2/1989 | Lo | 220/282 |

FOREIGN PATENT DOCUMENTS

| | | | |
|---|---|---|---|
| 656987 | of 1929 | France | 220/282 |

*Primary Examiner*—Stephen Marcus
*Assistant Examiner*—Vanessa M. Roberts
*Attorney, Agent, or Firm*—Bacon & Thomas

[57] ABSTRACT

A rectangular storage container having a pivotal cover and a body either of which having semicylindrical blocks or rods mounted to their structure providing fulcra in opening the cover. In a preferred embodiment, the storage container includes a square cover and a square body. The square cover comprises a pair of pivots on an inside surface and symmetrically positioned on opposite peripheral sides, a block on the inside surface and centrally positioned at a first end thereof, a chamfer at the first end, and a notch at an opposite second end thereof. The square body comprises an upper peripheral rim and a flange. The pair of pivots and the block rest on the upper peripheral rim of the body while the peripheral sides of the cover rest on the flange of the body. The pair of pivots serve as fulcra and thereby the cover can be opened by applying a force on the first end with the chamfer of the cover being flush with the flange of the body.

2 Claims, 8 Drawing Sheets

STORAGE CONTAINER WITH PIVOTABLE COVER

BACKGROUND OF THE INVENTION

This invention relates to a storage container, and more particularly, to a storage container having an easily openable pivotal cover.

This application is a continuation-in-part application of Ser. No. 448,253, filed Dec. 11, 1989, now abandoned.

The purpose of a storage container is to provide an air-tight seal between the cover or lid and the body or bowl. The air-tightness insures that food and other perishables will remain fresh as long as possible either in a refrigerated environment or at room temperature. And nowadays, it is desirable for the container to be able to withstand the temperatures imposed by the freezer, dishwasher, or microwave oven.

It is also beneficial that these storage containers, while insuring an air-tight fit, additionally allow the user to easily remove the cover when access to the contents is desired. While many storage containers satisfy the above requirements, they have the following disadvantage: to provide a cover that is easily opened, the covers themselves have had irregular shapes and complicated designs, lowering the aesthetic appeal of the container.

A storage container that is disclosed in my U.S. Pat. No. 4,807,778, issued on 28 Feb. 1898, overcame many of the limitations of prior art, but it does not fully achieve the aesthetic appeal desired, and additional improvements have been made thereto.

SUMMARY OF THE INVENTION

A primary objective of the present invention is to provide a storage container which is easily openable by the introductuion of a simple means to an existing storage container.

Another objective of the present invention is to provide an aesthetically pleasing storage container that opens easily.

A further objective of the present invention is to provide an easily manufactured storage container.

Other objectives, if not specifically set forth herein, will become apparent to those with ordinary skill in the art from the detailed description provided herebelow, with appropriate reference to the accompanying drawings.

DETAILED DESCRIPTION OF THE INVENTION

Figure 1:
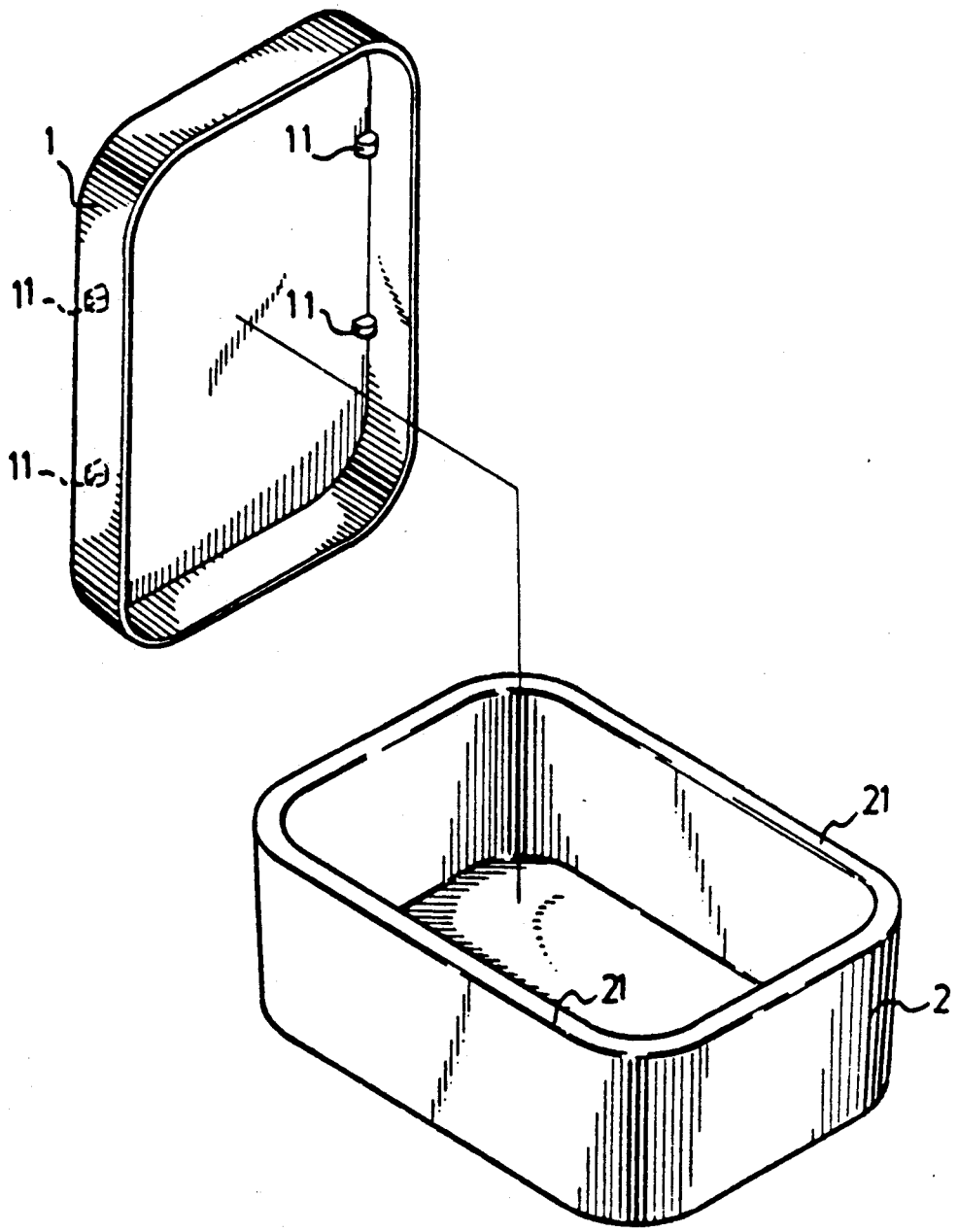
FIG. 1 is a perspective view of a storage container in accordance with the present invention, showing the cover removed from the body.

In reference to the drawings, and particularly to FIG. 1, it can be seen that a storage container generally comprises a rectangular cover 1 and a correspondingly rectangular body 2. The cover 1 is removably receivable on the body 2, with an inside periphery of the cover 1 fractionally larger than an outside periphery of the body 2, so as to cause sufficient contact between the two peripheries in order to insure an air-tight seal, but not as to cause substantial friction where the engagement between the cover 1 and the body 2 is performed with difficulty.

Mounted integrally on an inside surface of the cover 1, adjacent to the inside periphery, are four semi-cylindrical blocks 11. The position of the blocks 11 is important in that they must stably support the cover 1 on the body 2 while providing an efficiently placed fulcrum for easy opening. There are two blocks 11 equidistantly positioned on each side of the inside periphery, symmetrically opposite each other, as can be seen from FIGS. 1 and 2. The equidistant and symmetrical spacing, i.e., the space between the blocks is one third the length of a side, is essential to stably supporting the cover 1 on the body 2, and to maximizing the efficiency in opening or removing the cover 1 from the body 2.

Figure 2:
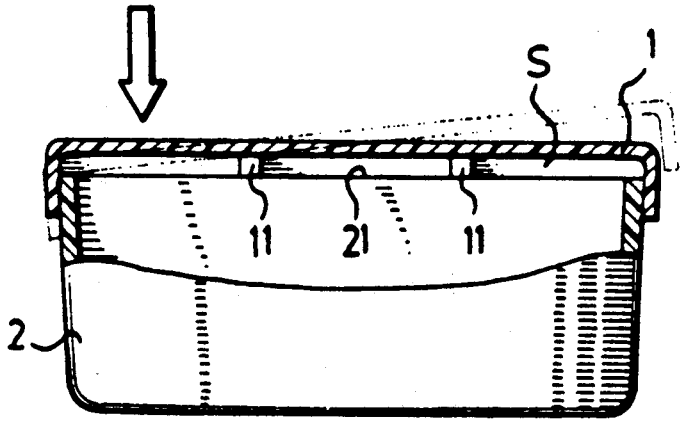
FIG. 2 is a partial cross-sectional side working view of the storage container of FIG. 1.

The removal is clearly shown in FIG. 2. When the cover 1 is positioned on the body 2 with the blocks 11 resting on an upper peripheral rim 21 of the body 2, and it is desired to open the container, the user applies a force (as shown by an arrow in FIG. 2) to a first end of the cover 1. This force causes the cover 1 to act as a lever, and a corresponding pair of blocks 11 to act as fulcra. There is a space (indicated by character S) between the inside surface of the cover 1 and the rim 21 of the body 2 provided by the blocks 11. The space S allows the cover 1 to pivot a sufficient distance, insuring that a second end of the cover 1 will be lifted away from the body 2 for easy removal, shown by phantom lines in FIG. 2

It should be known that the removal procedure and operation described above will be essentially the same for the embodiments shown in FIGS. 3, 4, and 5, through the configuration of the fulcra will be different and will therefore be subsequently described.

Figure 3:
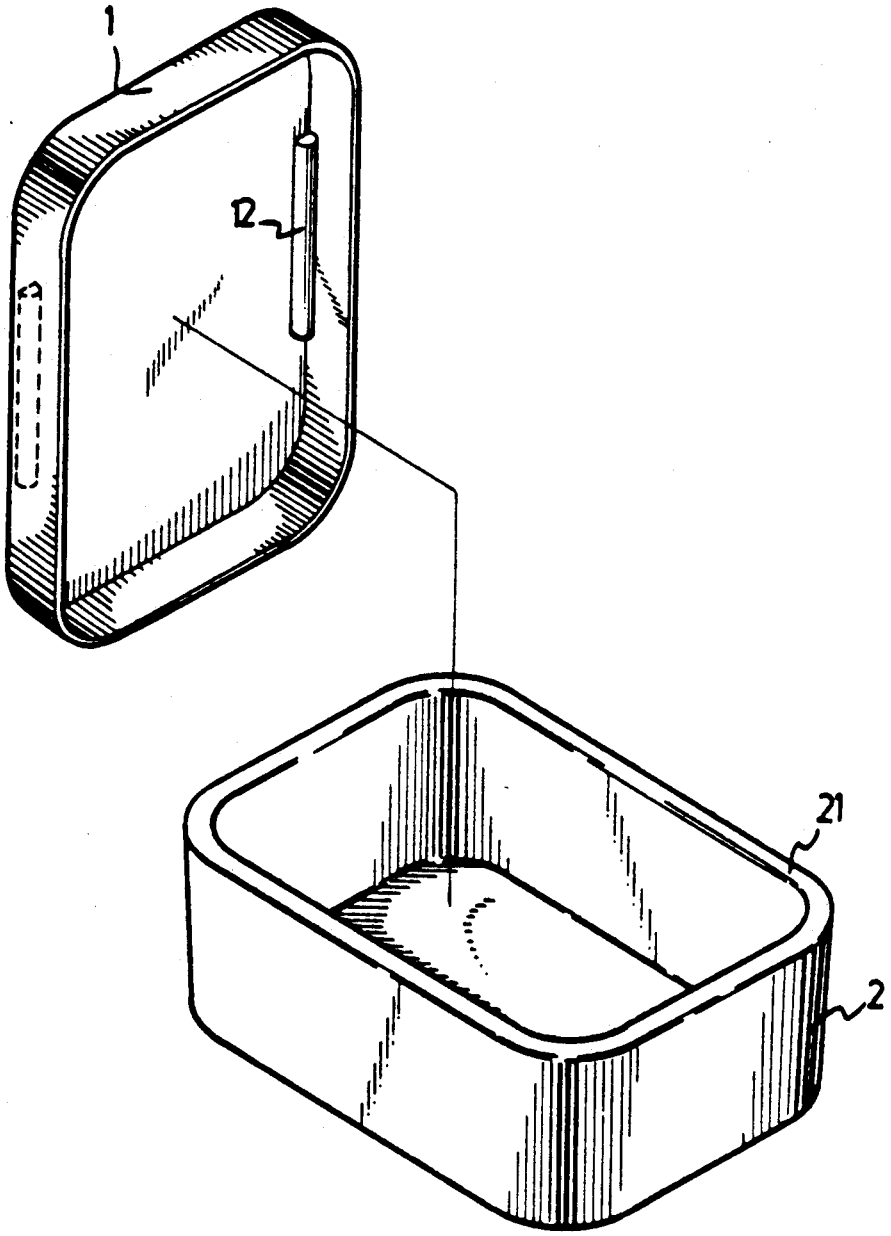
FIG. 3 is a view similar to FIG. 1, showing another embodiment in accordance with the present invention.

FIG. 3 shows another embodiment of the present invention wherein semi-cylindrical rods 12, placed on the inside surface of the cover 1 adjacent to the inside periphery, provide the fulcra in the removal procedure previously described. The length of the rods 12 is one third the length of the side of the cover 1, thereby providing equidistant spacing between first ends and second ends of the rods 12. These ends act as the fulcra when the force is applied to one end of the cover 1.

Figure 4:
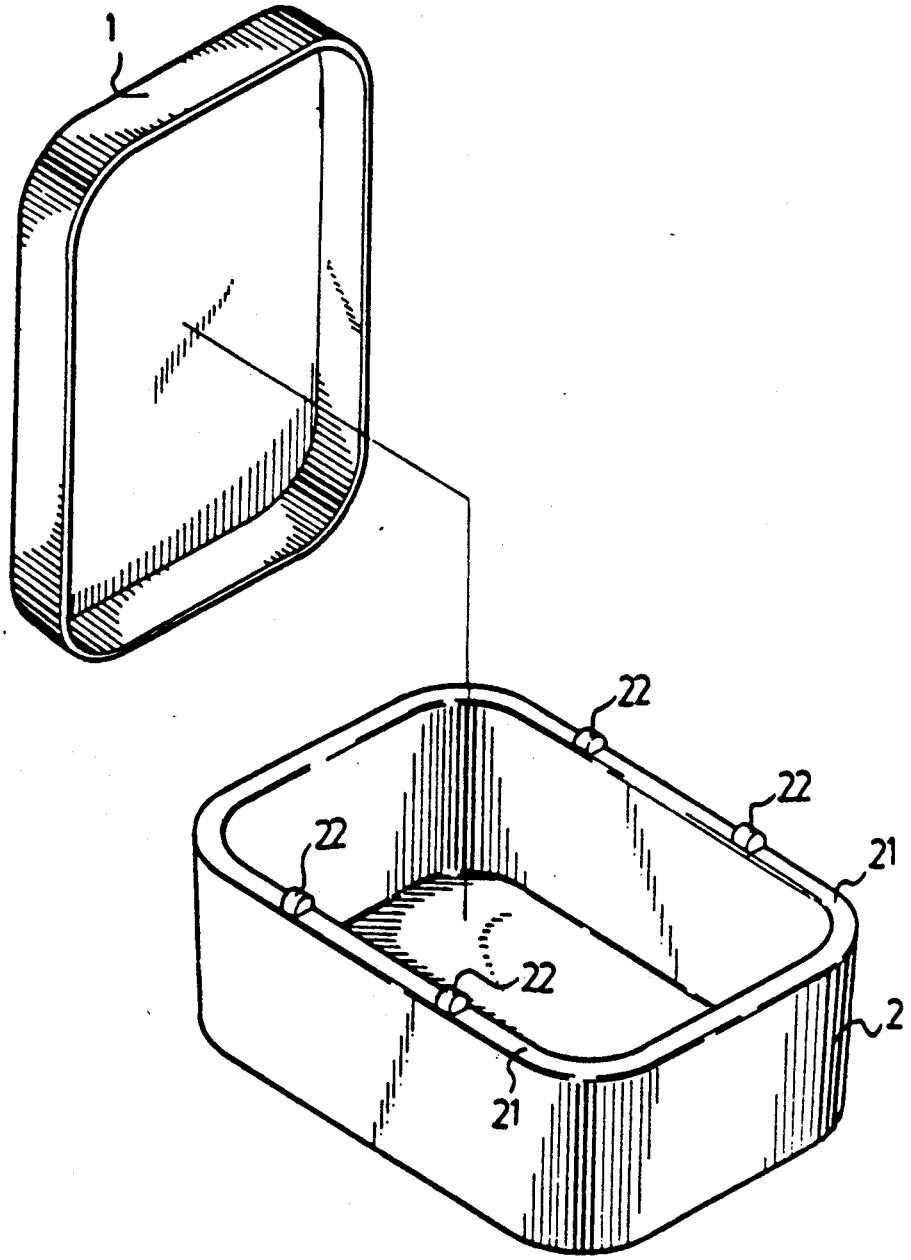
FIG. 4 is a view similar to FIG. 1, showing a further embodiment in accordance with the present invention.
Figure 5:
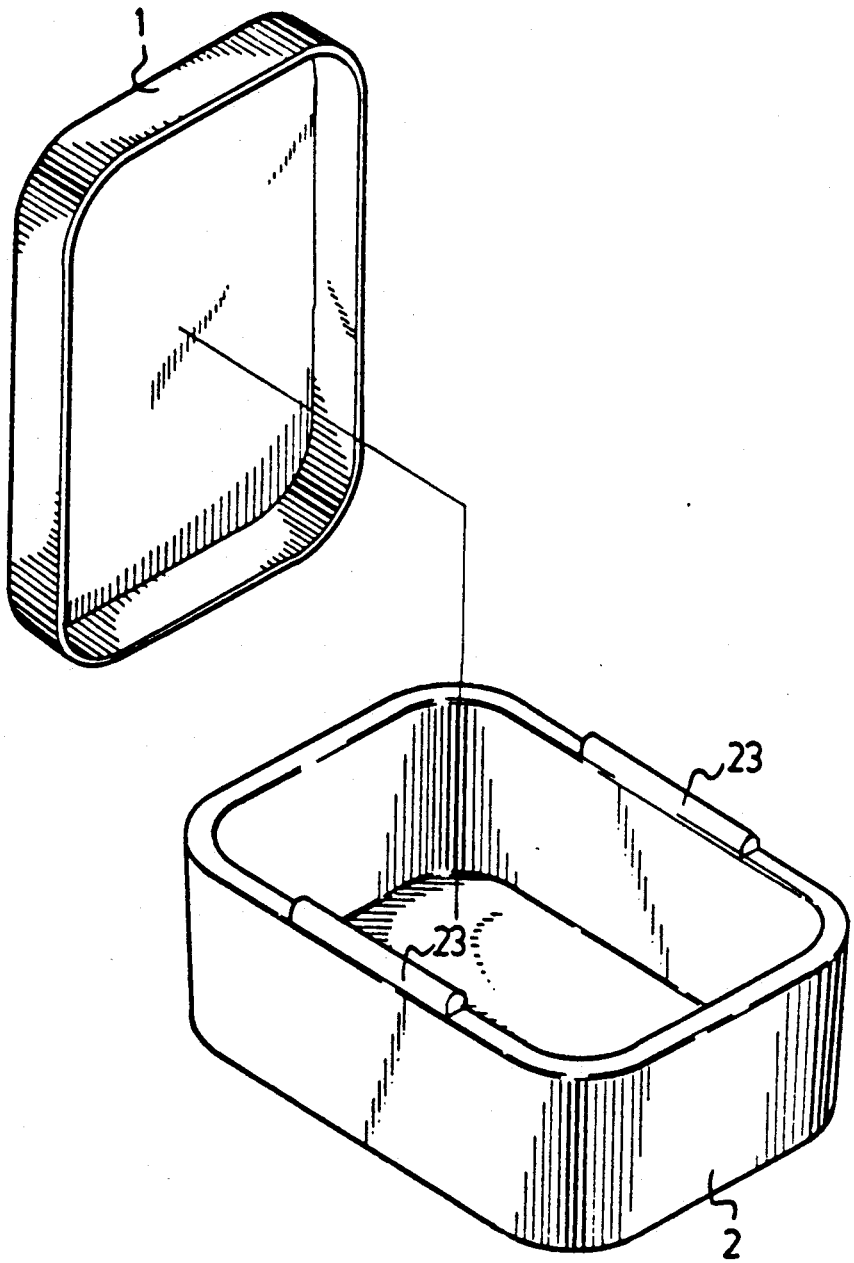
FIG. 5 is a view similar to FIG. 1, showing yet another embodiment in accordance with the present invention.

Further embodiments of the present invention are illustrated in FIGS. 4 and 5. The difference between these two embodiments and the previous two embodiments is that the blocks 11 and rods 21 are now placed on the rim 21 of the body 2, and are indicated by the reference numbers 22 and 23, respectively. The equidistant spacing of the blocks 22 and the length of the rods 23 are the same as previously described, and the removal procedure is also identical.

Figure 6:
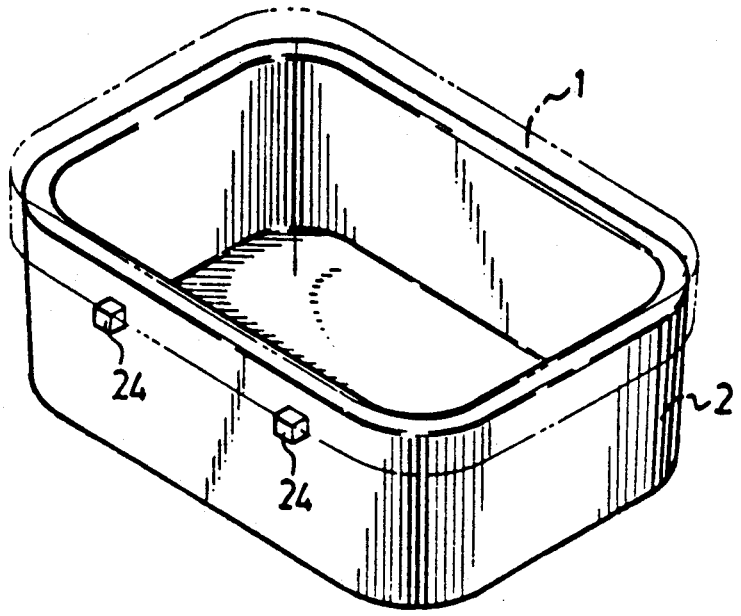
FIG. 6 is a perspective view of still another embodiment in accordance with the present invention.

Still a further embodiment is shown in FIG. 6, wherein four blocks 24 are placed on the outside periphery of the body 2; a pair of blocks 24 on each side. The equidistant and symmetric spacing is the same as previously described, and the transverse positioning is such that the space (S) in FIG. 2 is still present. The periphery of the cover 1 rests on the blocks 24, and the facilitated procedure is the same as in the previous embodiments.

Figure 7:
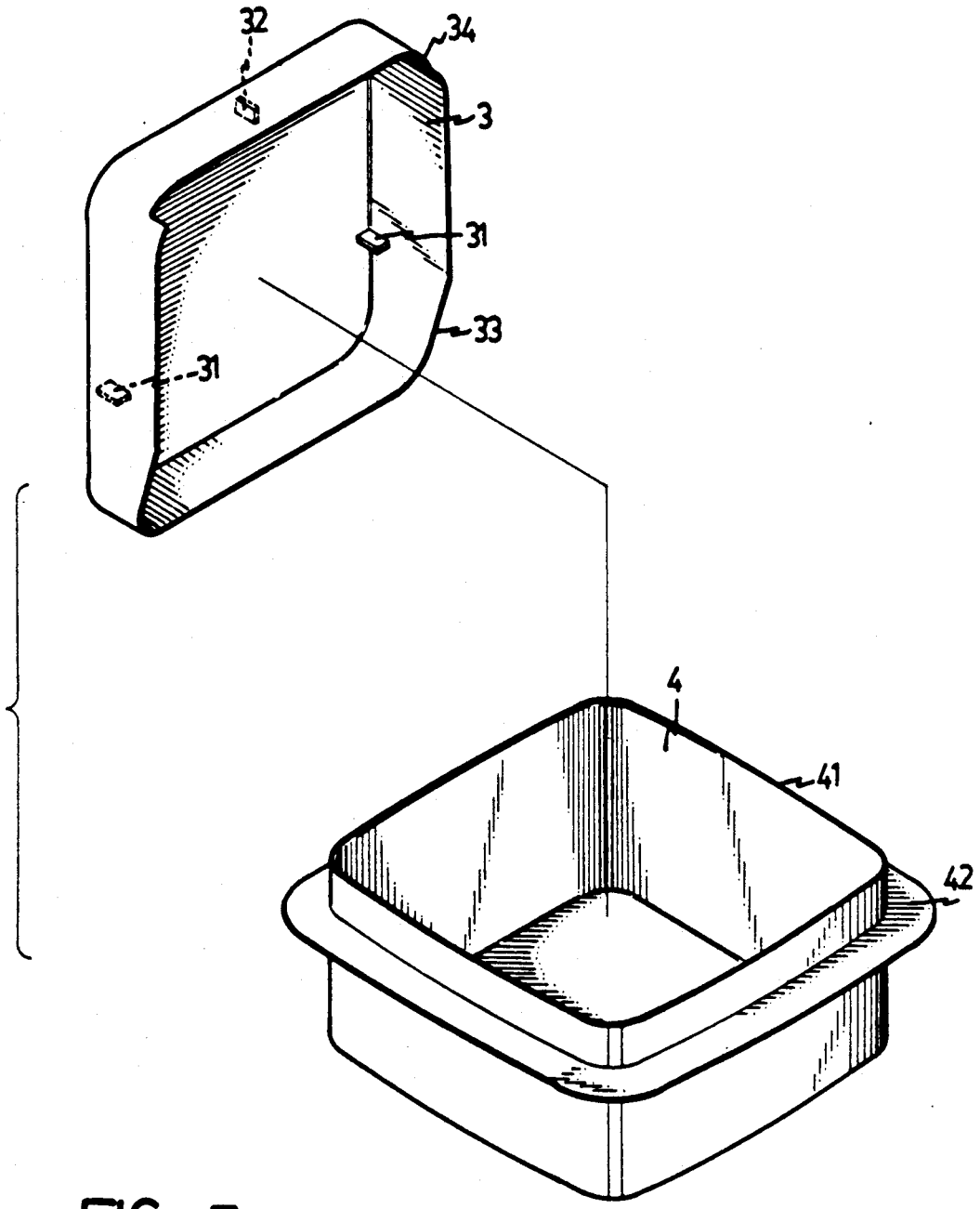
FIG. 7 is a view similar to FIG. 1, showing yet still another embodiment in accordance to the present invention.
Figure 8:
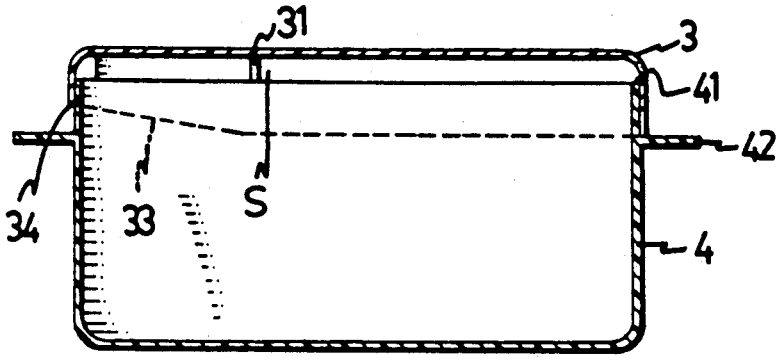
FIG. 8 is a cross-sectional view of the storage container of FIG. 7.
Figure 9:
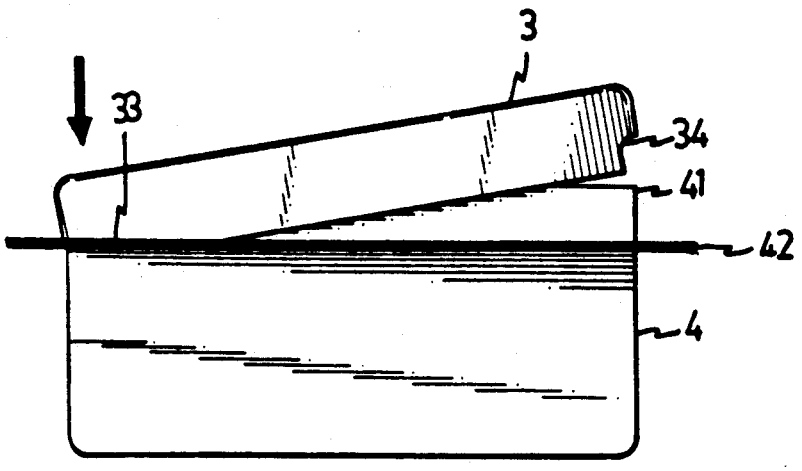
FIG. 9 is a side working view of the storage container of FIG. 7.

FIGS. 7, 8 and 9 show yet another embodiment of the present invention. As previous embodiments, the storage container generally comprises a cover 3 and a body 4, although the configurations are modified somewhat in this embodiment. The cover 3 comprises a pair of pivots 31, a block 32, a chamfer 33 at a first end thereof, and a notch 34 at an opposite second end thereof. The block 32 is integrally mounted on an inside surface of the cover 3, centrally positioned at the first end thereof. The pivots 31 are also integrally mounted on the inside surface of the cover 3, but are symmetrically positioned on opposite sides of the inside periphery; their location from the second end being approximately one third the length of the side. The chamfer 33 is angled from the location of the pivots 31 to a distance approximately one third the transverse length of the second end. The body 4 comprises a peripheral rim 41 and a flange 42, integral and circumambient around an outside periphery thereof.

When the cover 3 is placed on the body 4, as shown in FIG. 8, the pivots 31 and block 32 rest on the rim 41 while side peripheries of the cover 3 rest on the flange 42, creating a space (S) between the inside surface of the cover 3 and the rim 41 of the body 4. To open the container, a force (as shown by an arrow in FIG. 9) is applied to the second end of the cover 3, causing the cover 3 to rotate about the fulcra provided by the chamber 33 and pivots 31, thereby lifting the first end of the cover 3 a sufficient distance and allowing the cover 3 to be removed from the body 4.

The block 32 provides additional support for the cover 3 when it is resting on the body 4, and prevents an attempt to depress the second end of the cover 3 which would cause an improper removal procedure. The provision of the notch 34 at the first end of the cover 3 reduces the surface area of contact between the inside periphery of the cover 3 and the outside periphery of the body 4 (the outside area below the rim 41 and above the flange 42). The reduced contact surface area will reduce the frictional force between the two surfaces thereby reducing the force needed to to open the container. The notch 34 also functions as a vent during microwave use. To perform this function, the container is in the embodiment of FIG. 9, and the notch 34 allows the water vapor to vent from the container.

From the foregoing, a storage container with a pivotal cover in accordance with several embodiments has been described. The container comprises a cover and a body which include means applied thereto to facilitate the opening of the container. Accordingly, other additions and modifications will become apparent to those of ordinary skill in the art and all of such modifications are intended to be within the scope of the appended claims.

I claim:

1. A storage container having a square body including an upper peripheral rim and a flange, a corresponding square cover encompassing the upper peripheral rim of the square body, the square cover being capable of being opened with respect to the rectangular body by applying a force to an end thereof, the improvement comprising:

said square cover comprising a pair of pivots integrally formed on an inside surface and symmetrically positioned on opposite peripheral sides, a block integrally formed on said inside surface and centrally positioned at a first end thereof, a notch at said first end, and a chamfer at an opposite second end thereof, said pair of pivots being positioned from said second end a distance substantially one third the length of the side of said square cover, said chamfer being angled from said pivots to a distance substantially one third a side width of said square cover, said pair of pivots and said block resting on said upper peripheral rim of said square body while said peripheral sides of said square cover resting on said flange of said square body;

whereby said square cover is able to pivot in response to applying said force on said second end thereof to open, with said chamfer of said square cover being flush with said flange of said square body.

2. The storage container as claimed in claim 1, wherein said notch functions as a vent to allow venting of water vapor from within said square body when said chamfer of said square cover is substantially flush with said flange of said square body.

* * * * *